United States Patent [19]

Leupold et al.

[11] Patent Number: 4,831,351

[45] Date of Patent: May 16, 1989

[54] PERIODIC PERMANENT MAGNET STRUCTURES

[75] Inventors: Herbert A. Leupold, Eatontown; Ernest Potenziani, II, Ocean, both of N.J.

[73] Assignee: The United States of America as represented by the Secretary of the Army, Washington, D.C.

[21] Appl. No.: 213,970

[22] Filed: Jul. 1, 1988

[51] Int. Cl.[4] ..... B72S 1/04

[52] U.S. Cl. ..... 335/306; 315/5.35

[58] Field of Search ..... 335/302, 304, 306, 212; 315/5.24, 5.34, 5.35

[56] References Cited

U.S. PATENT DOCUMENTS 2,952,803 9/1960 Charles et al. ..... 335/302

3,768,054 10/1973 Neugebauer ..... 335/306 X 4,392,078 7/1983 Noble et al. ..... 315/5.35

4,429,229 1/1984 Gluckstern ..... 335/212 X 4,614,930 9/1986 Hickey et al. ..... 335/306 X

*Primary Examiner*—George Harris

*Attorney, Agent, or Firm*—Sheldon Kanars; John K. Mullarney

[57] ABSTRACT

Periodic permanent magnet structures comprise a plurality of hollow spherical magnetic flux sources each of which produces a uniform high-field in its spherical central cavity. Each sphere has an axial bore hole through its magnetic poles. The spheres are disposed tangent to each other with the axial bore holes of the same coaxially aligned to form a continuous channel or path through which a beam of charged particles can travel.

12 Claims, 4 Drawing Sheets

PERIODIC PERMANENT MAGNET STRUCTURES

The invention described herein may be manufactured, used, and licensed by or for the Government for governmental purposes without the payment to us of any royalties thereon.

TECHNICAL FIELD

The present invention relates to high-field periodic permanent magnet structures for use in microwave/millimeter wave devices such as traveling wave tubes (TWTs).

BACKGROUND OF THE INVENTION

Both electromagnets and permanent magnets have been used to manipulate beams of charged particle.. In traveling wave tubes, for example, magnets have been arranged around the channel through which the beam travels to focus the stream of electrons; that is, to reduce the tendency of the electrons to repel each other and spread out. Various configurations of permanent magnets (and pole pieces) have been tried in an attempt to increase the focusing effect while minimizing the weight and volume of the resulting device. In conventional traveling wave tubes, permanent magnets are typically arranged in a sequence of alternating magnetization, either parallel to, or anti-parallel to, the direction of the electron flow. The magnets (and pole pieces) are usually annular in shape and their axes are aligned with the path of the electron beam. Pole pieces, constructed of ferromagnetic material such as electrolytic iron, are, often placed between the magnets and provide a path through which magnetic flux from the magnets may be directed into the working space along the axis of the traveling wave tube in order to influence the beam in the desired manner. The patent to Clarke, U.S. Pat. No. 4,731,598, issued Mar. 15, 1988, illustrates typical prior art, periodic permanent magnetic (PPM) structures.

One of the critical problems confronting those who develop magnetic structures used to contain or manipulate beams of charged particles has been how to more efficiently utilize the permanent magnet materials which make up the structure(s). Some specific problems include how to maximize the strength of the magnetic field along the path of the charged particle beam without increasing the mass of the magnetic structure; how to improve performance (e.g., output power); and how to increase the useful life of the TWTs. The present invention addresses these problems.

SUMMARY OF THE INVENTION

A primary object of the present invention is to increase the magnetic field along the path of a charged particle beam so as to improve (TWT) performance.

Related objects of the invention are to achieve a higher maximum peak field along the aforementioned particle beam path, to achieve a greater average field along said path, and to achieve greater field uniformity along said path.

The present invention makes advantageous use of the "magic sphere" disclosed in the co-pending application of H. Leupold (a present co-inventor), Ser. No 199,500, filed May 27, 1988. The magic sphere is a hollow spherical flux source that produces a uniform high-field in its spherical central cavity. The hollow sphere is comprised of magnetic material and its magnetization is azimuthally symmetrical. An axial bore hole through the magnetic poles provides access to the uniform high-field in the central cavity.

In accordance with the present invention, a series of magic spheres (e.g., 10 or more) are placed tangent to each other in pearl string fashion The axial bore holes of the spheres are coaxially aligned with each other to form a continuous channel or path through which a beam of charged particles will travel. The magic spheres are closely alike; and, in a preferred embodiment of the invention the magnetic field orientations in the central cavities of the spheres are the same. In another embodiment, the magnetic field orientations alternate from sphere to sphere.

The present invention makes advantageous use of the fact that in any given magic sphere the magnetic field orientation in the axial bore hole is the reverse of that in the central cavity Thus, the desirable characteristic of alternating magnetization i a PPM stack is fully realized in a string of coaxially aligned magic spheres.

BRIEF DESCRIPTION OF THE DRAWINGS

The invention will be more fully appreciated from the following detailed description when the same is considered in connection with the accompanying drawings in which.

DETAILED DESCRIPTION

Figure 1:
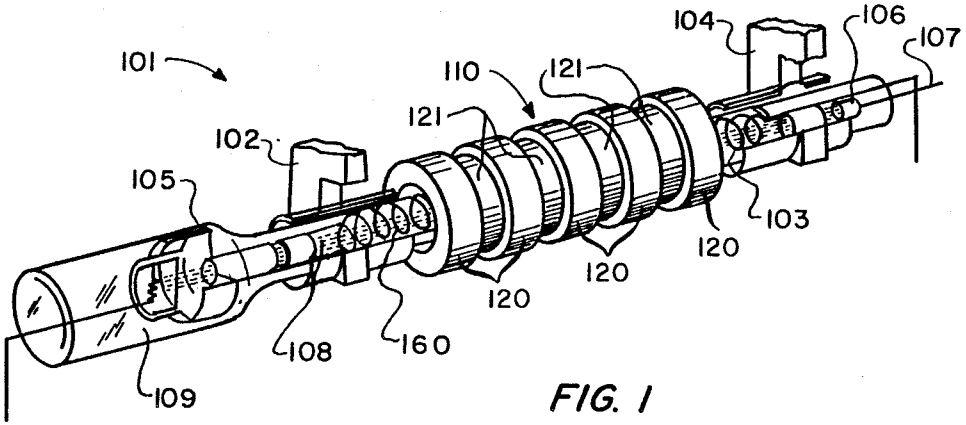
FIG. 1 (PRIOR ART)
FIG. 1 is a perspective view of a typical prior art traveling wave
Figure 2:
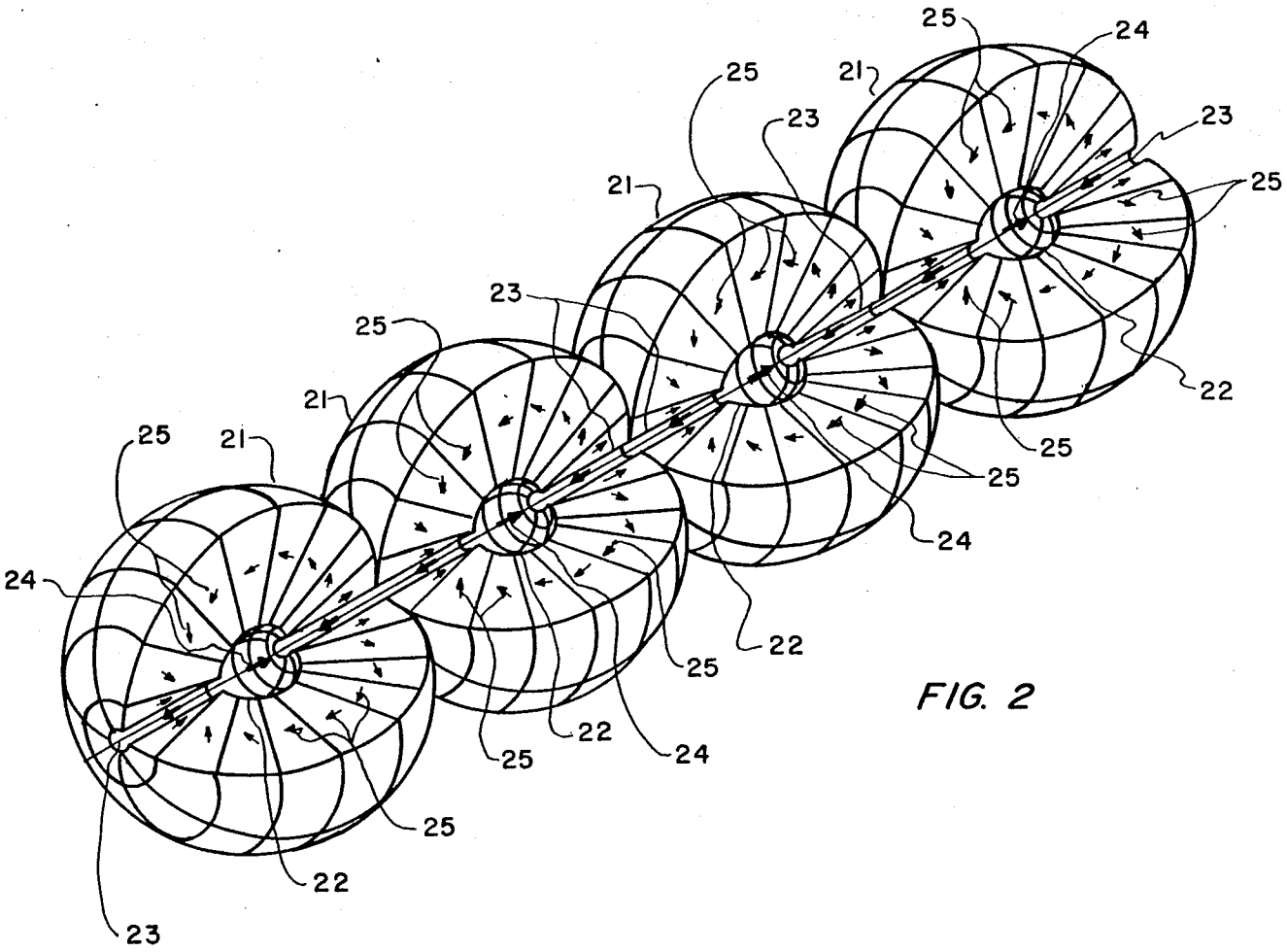
FIG. 2 is a short series of coaxially aligned magic spheres forming a PPM in accordance with the present invention.

FIG. 1 shows a conventional traveling wave tube (TWT) 101. The major components of the TWT 101 are contained within the tube body 109. An evacuated working space 160 is established within the beam focusing structure 110 along the axis 107 of the tube 101 A microwave signal is applied at the input 102 and extracted at the output 104. This signal travels through the helical structure 103, which is wrapped around the longitudinal axis 107 of the tube 101. An electron beam 108 is produced by the electron gun 105, projected down the axis 107 of the tube 101, and absorbed at the collector 106. To focus the beam 108, a beam focusing system 110 surrounds the beam 108 and the helical structure 103. The interaction between the electron beam 108 and the microwave signal produces an amplification of the microwave signal The beam focusing structure 110 is designed to tightly focus the charged particle beam 108. The annular permanent magnets 120 are disposed in a coaxial manner with respect to the particle beam. The permanent magnets are typically arranged in a sequence of alternating magnetization, that is, the magnetic orientation alternates from magnet to magnet in the sequence Magnets arranged in this alternating pattern are called "periodic permanent magnets". In between each of the successive magnets is an annular pole piece 121 which acts to draw magnetic flux from the magnets into the working space surrounding the beam path. Since TWTs and PPMs are so well known and so extensively described in the literature, the foregoing brief description should suffice for present purposes The periodic permanent magnet structures of the present invention make advantageous use of a new and novel permanent magnet configuration, i.e., the magic sphere. FIG. 2 shows a series of four coaxially aligned magic spheres, which are partially cut-away for illustrative purposes For TWT purposes upwards of 10 or more such spheres would be used to make up the PPM structure. However, it is to be understood that the principles of the present invention are in no way limited to any particular number of spheres utilized to make-up a PPM and different numbers of spheres may be used in different applications The magic spheres 21 are alike, and each comprises a spherical central cavity 22 and an axial bore hole 23 through the magnetic poles of the sphere. The magic spheres 21 are tangent to each other and coaxially aligned to form a continuous channel or path through which a beam of charged particles will travel. As indicated by the large arrows 24, the magnetic field orientations in the central cavities 22 are the same—i.e., in the same axial direction. However, the magnetic field orientation in each axial bore hole is the reverse of that in each cavity. Accordingly, the desirable characteristic of continually alternating magnetization in a PPM stack is fully realized in the string of magic spheres 21. That is, along the aforementioned channel or particle beam path the direction of the focusing magnetic field alternates or reverses in direction.

It is perhaps of advantage at this point to briefly describe the magic sphere itself. For a more detailed description of the same reference may be had to the above-noted co-pending application of H. Leupold. The magic sphere is a hollow spherical "flux source that provides a uniform high-field in its spherical central cavity The hollow sphere is comprised of magnetic material and its magnetization is azimuthally symmetrical. The magnetic orientation ($\alpha$) in the spherical permanent magnet shell is related to the polar angle ($\theta$); $\alpha=2\theta$. The value $\alpha$ is the magnetization angle with respect to the polar axis and the same is depicted by the small arrows 25 in FIG. 2. As indicated previously, a magic sphere will typically be provided with an axial bore hole through its magnetic poles.

Since it is not feasible to construct an ideal magic sphere that consists of a unitary, hollow spherical body of magnetic material, a segmented approximation such as shown in the spheres of FIG. 2 is utilized. Fortunately, even with as few as 64 segments per sphere, more than 90 percent of the field of an ideal structure is obtainable. However, it is to be understood, that the magic spheres used in accordance with the present invention might be comprised of a fewer or larger number of segments The greater the number of segments the closer the approximation to the ideal case.

Figure 3:
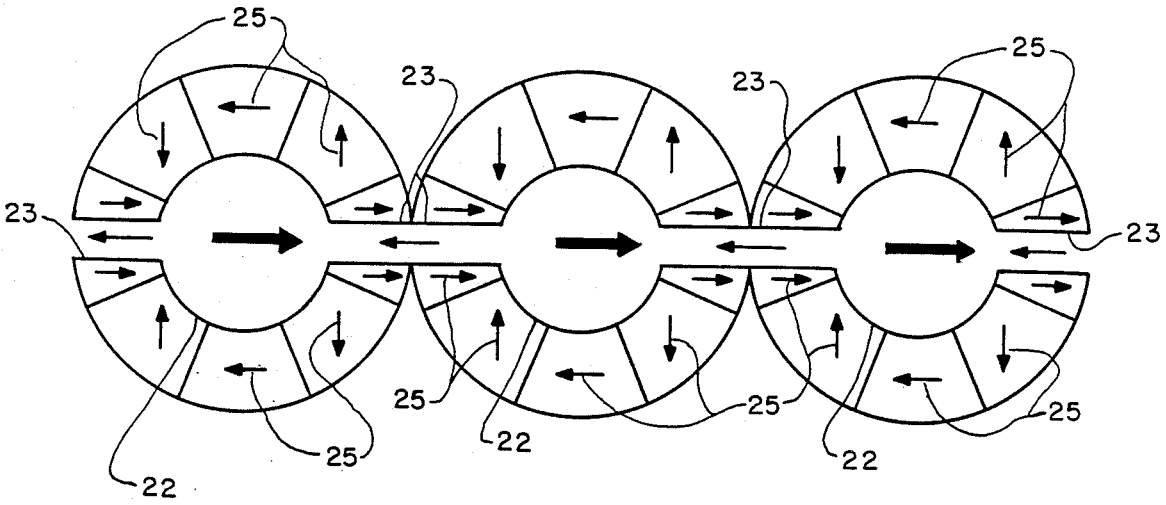
FIG. 3 is a cross section view of three magic spheres that are field aligned in accordance with the preferred embodiment of the invention.

FIG. 3 is a cross section view of three of the magic spheres of FIG. 2, which are coaxially aligned and field aligned, i.e., the magnetic field orientations in the central cavities 22 are in the same direction. And, the magnetic field orientation in the coaxial bore holes 23 is the reverse of that in the cavities. The arrows 25 depict the magnetic orientation in the magnetic shell. The inner (cavity) radius and the wall o shell thickness are the same (e.g., 2 cm).

Figure 4:
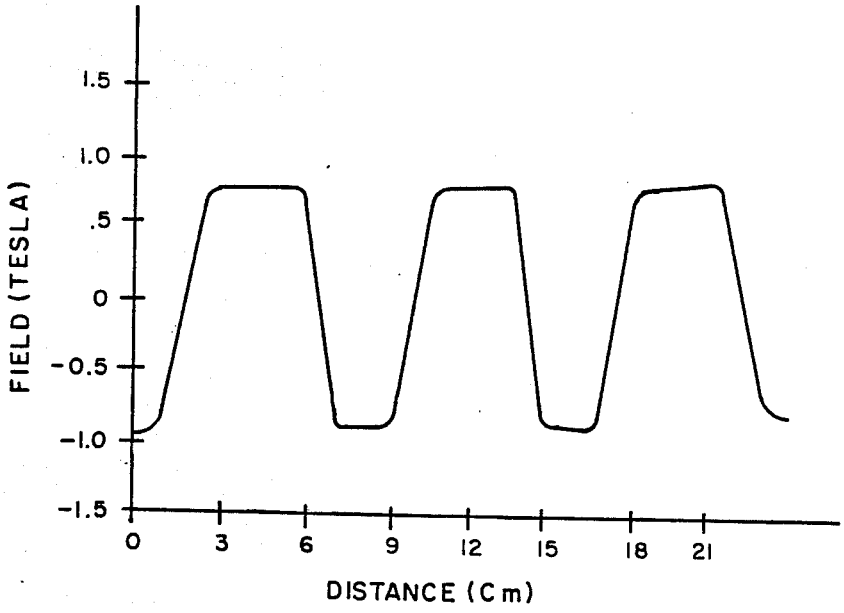
FIG. 4 is a curve showing the on-axis longitudinal field profile of the FIG. 3 embodiment.

FIG. 4 shows the on-axis longitudinal field profile of the FIG. 3 embodiment of the invention. The FIG. 4 plot is for magic spheres with an inner radius and wall thickness of 2 cm. and a $B_n$ (magnetic remanence) of 1 tesla. The coaxial bore holes 23 were varied from 2 to 10 mm hole diameter and substantially the same curve shown in FIG. 4 was obtained in each case. A PPM stack in accordance with the invention is very forgiving with regard to bore holes that are drilled axially through the magnetic poles, and which can be up to one-fourth the diameter of the central cavity(s).

Figure 5:
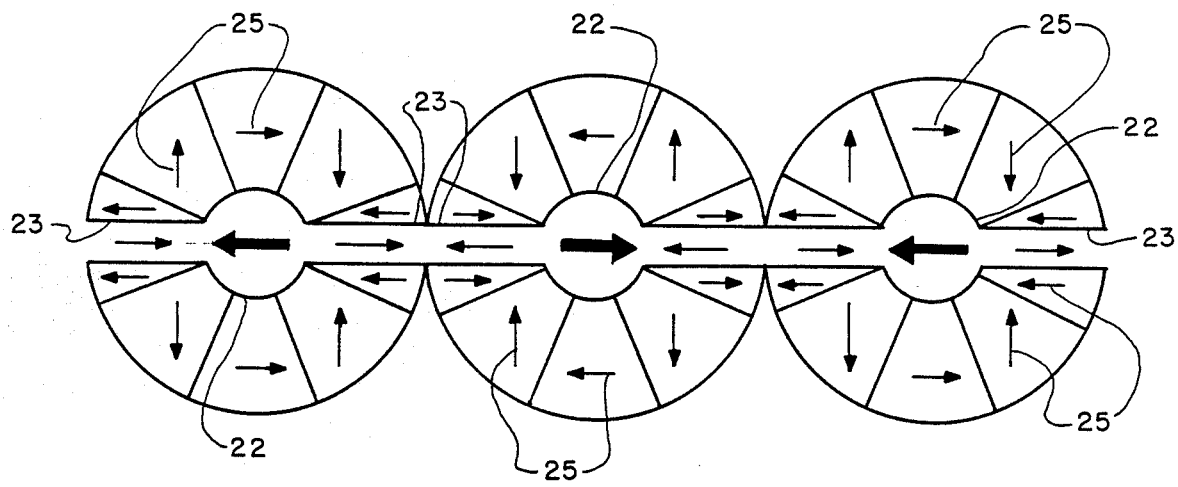
FIG. 5 is a cross section view of three magic spheres wherein the cavity field orientation alternates from sphere to sphere.

FIG. 5 is a cross section view of three coaxially aligned magic spheres wherein the magnetic field orientation in the central cavities 22 alternates or reverses from sphere to sphere And, the magnetic field orientation in the bore hole 23 of each sphere is the reverse of that in the central cavity of the sphere. Once again, the reference numeral 25 depicts the magnetic orientation in the spherical permanent magnet shell(s).

Figure 6:
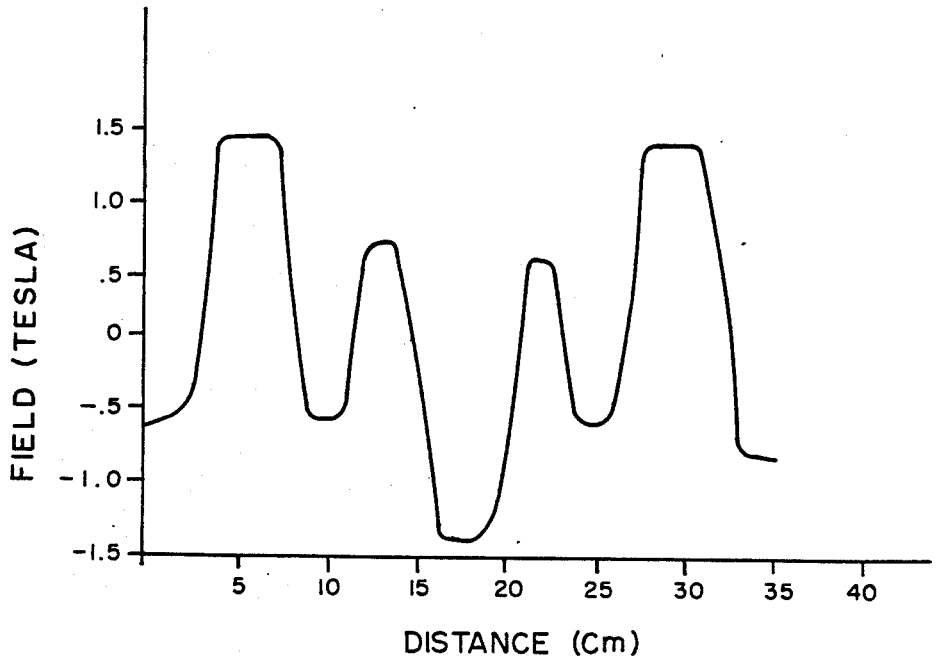
FIG. 6 is a curve showing the on-axis longitudinal field profile of the FIG. 5 embodiment.

FIG. 6 shows the on-axis longitudinal field profile of the FIG. 5 embodiment of the invention. The FIG. 6 plot is for magic spheres with an inner radius of 2 cm, a wall thickness of 4 cm, and a $B_n$ of 1 telsa. The coaxial bore holes 23 of FIG. 5 were varied from 2 to 10 mm hole diameter and substantially the same curve shown in FIG. 6 was obtained in each case.

Considering the curves of FIGS. 4 and 6 in greater detail, it should be noted that the approximately square-wave pattern shown in FIG. 4 contrasts significantly with the more-or-less sinusoidal pattern formed in conventional prior art PPM structures. This, of course, results in an average field that is close to that at maximum rather than the $2/\pi$ of maximum of prior art PPM structures. As will be appreciated by those in this art, this greater average field results in more efficient TWT performance—a more tightly focused beam and hence a greater power output, increased tube life, etc. The field maxima are also considerably higher in this type of configuration (FIG. 3) than in prior art PPM structures of the same periodicity and electron beam diameter. For example, for the embodiment shown in FIG. 3 the field amplitude would be about 8.0–9.0 kOe as opposed to the approximately 6 kOe obtainable in prior art PPM structures of similar bulk, weight, period, and bore size. If mass is not a significant consideration, the FIG. 5 embodiment may be advantageously used. As shown in FIG. 6, the field reaches 14–15 kOe along parts of the beam path, a value double that obtainable by conventional PPM structures of the same period and bore at any magnet mass.

The field profile illustrated in FIG. 4 shows good uniformity. By changing (e.g., increasing) the wall thickness vis-a-vis the inner radius this uniformity can be enhanced. Also, by increasing wall thickness the fields of FIG. 4 can be increased in magnitude. The field profile shown in FIG. 6 shows less uniformity than that shown in FIG. 4; however, greater maximum fields: along the beam path are exhibited. And, here again, by changing the wall thickness vis-a-vis the inner radius of the FIG. 5 embodiment greater field uniformity can be achieved A close approximation to the desired field profile can be arrived at without undue experimentation, carried out either physically or preferably mathematically It should be noted that the value of B for the series of magic spheres, or even for specific ones in the series, can also be changed to meet some design criteria Accordingly, depending upon the intended application, a preferred magnetic field profile can be arrived at using either the embodiment of FIG. 3 or that of FIG. 5 perhaps modified in a manner such as suggested above.

Having shown and described what is at present considered to be several preferred embodiments of the invention, it should be understood that the same has been shown by way of illustration and not limitation And, all modifications, alterations and changes coming within the spirit and scope of the invention are meant to be included herein.

What is claimed is:

1. A periodic permanent magnet structure comprising a plurality of hollow substantially spherical magnetic flux sources each of which produces a uniform high-field in its spherical central cavity, each sphere having an axial bore hole through the magnetic poles of the sphere, the spheres being placed tangent to each other with the axial bore holes of the spheres coaxially aligned with each other so as to form a continuous channel through the plurality of spheres.

2. A periodic permanent magnet structure as defined in claim 1 wherein the magnetic field orientations in the central cavities of the series of spheres are the same.

3. A periodic permanent magnet structure as defined in claim 2 wherein the spheres are of the same dimensions, and the magnetic field orientation in each axial bore hole is the reverse of that in each central cavity.

4. A periodic permanent magnet structure as defined in claim 3 wherein the shell thickness of each hollow sphere is equal to the cavity radius of the same.

5. A periodic permanent magnet structure as defined in claim 4 wherein said plurality of spheres comprises at least ten in number.

6. A periodic permanent magnet structure as defined in claim 5 wherein said axial bore holes are of a diameter up to one-fourth the diameter of said central cavity.

7. A periodic permanent magnet structure as defined in claim 1 wherein the magnetic field orientation in the central cavities of he series of spheres alternates in direction from sphere to sphere.

8. A periodic permanent magnet structure as defined in claim 7 wherein the spheres are of the same dimensions, and the magnetic field orientation in each axial bore hole is the reverse of that in each central cavity of a given sphere.

9. A periodic permanent magnet structure as defined in claim 8 wherein the shell thickness of each hollow sphere is twice, the cavity radius of the same.

10. A periodic permanent magnet structure as defined in claim 9 wherein said plurality of spheres comprises at least ten in number.

11. A periodic permanent magnet structure as defined in claim 10 wherein said axial bore holes are of a diameter up to one-fourth the diameter of the central cavity.

12. A periodic permanent magnet structure that provides a focusing magnetic field o alternating direction for use in traveling wave tubes comprising a series of hollow substantially spherical magnetic flux sources each of which produces a uniform high-field in its central cavity, each central cavity being substantially spherical, each spherical flux source having an axial bore hole through the magnetic poles of the same, each spherical flux source being azimuthally symmetrical in magnetization, the magnetic orientation in each spherical magnetic shell being substantially equal to twice the polar angle, each spherical source being comprised of a multiplicity of segments which extend in a tapered manner from the central cavity to the outer surface of the sphere, the spherical sources being placed tangent to each other with their axial bore holes coaxially aligned with each other to form a continuous channel through which a beam of electron can travel, the magnetic field orientations in the central cavities of the series of spheres being in the same axial direction, and the magnetic field orientation in the axial bore holes being in the opposite axial direction.

* * * * *